US006451756B2

(12) United States Patent
Shulman et al.

(10) Patent No.: US 6,451,756 B2
(45) Date of Patent: Sep. 17, 2002

(54) METHOD OF PROMOTING SOIL RELEASE FROM FABRICS

(76) Inventors: Jan Edward Shulman, 8 Hibiscus Pl., Newtown, PA (US) 18940; Thomas Cleveland Kirk, 861 Sackettsford Rd., Ivyland, PA (US) 18974; Graham Swift, 215 Winged Foot Dr., Blue Bell, PA (US) 19442; Curtis Schwartz, 437 Edgewood Dr., Ambler, PA (US) 19002; Marianne Patricia Creamer, 1827 Buttonwood Way, Warrington, PA (US) 18976; Beth Ann Falcone, 2723 Castle Dr., Bensalem, PA (US) 19020

( * ) Notice: Subject to any disclaimer, the term of this patent is extended or adjusted under 35 U.S.C. 154(b) by 0 days.

(21) Appl. No.: 09/878,445

(22) Filed: Jun. 11, 2001

Related U.S. Application Data

(62) Division of application No. 09/400,630, filed on Sep. 20, 1999, now abandoned.
(60) Provisional application No. 60/105,176, filed on Oct. 22, 1998.

(51) Int. Cl.[7] ..... C11D 3/37
(52) U.S. Cl. ..... 510/475; 510/516; 510/476; 8/115.6
(58) Field of Search ..... 510/476, 516, 510/475; 8/115.6

(56) References Cited

U.S. PATENT DOCUMENTS

| | | | | |
|---|---|---|---|---|
| 3,557,039 A | | 1/1971 | McIntyre et al. | |
| 3,897,026 A | | 7/1975 | Yoshihiro et al. | |
| 3,993,830 A | | 11/1976 | Dickson et al. | |
| 4,404,309 A | | 9/1983 | Masler et al. | |
| 4,797,223 A | | 1/1989 | Amick et al. | |
| 4,956,421 A | | 9/1990 | Denzinger et al. | |
| 5,008,329 A | | 4/1991 | Aoki et al. | |
| 5,049,302 A | | 9/1991 | Holland et al. | |
| 5,066,749 A | * | 11/1991 | Leighton et al. | 526/271 |
| 5,700,331 A | * | 12/1997 | Thomas et al. | 134/29 |
| 6,087,310 A | * | 7/2000 | Henkel | 510/138 |

FOREIGN PATENT DOCUMENTS

| | | |
|---|---|---|
| CA | 1100262 | 5/1981 |
| EP | 0 324 568 A2 | 7/1989 |
| EP | 0 543 562 A3 | 5/1993 |
| EP | 0 786 514 A2 | 7/1997 |
| EP | 0 786 516 A2 | 7/1997 |
| GB | 1314897 | 4/1973 |
| GB | 1467098 | 3/1977 |

* cited by examiner

*Primary Examiner*—John Hardee
(74) *Attorney, Agent, or Firm*—Stephen E. Johnson

(57) ABSTRACT

Hydrophobically modified polycarboxylate polymers of Formula 1:

Formula 1

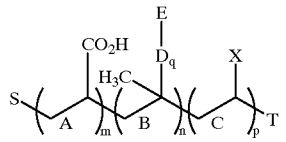

are useful for promoting soil release from fabrics, particularly cotton and cotton-containing fabrics, by contacting the fabrics with compositions comprising said polymers.

10 Claims, No Drawings

METHOD OF PROMOTING SOIL RELEASE FROM FABRICS

This is a divisional of U.S. application Ser. No. 09/400,630, filed Sep. 20, 1999, now ABN, which claims the benefit of U.S. application No. 60/105,176, filed Oct. 22, 1998.

The present invention relates to hydrophobically modified polycarboxylate polymers and a method for promoting soil release from fabrics, particularly cotton and cotton-containing fabrics, by contacting the fabrics with compositions comprising said polymers.

Soil on laundry falls into two general categories; either i) clay soil comprising particles which generally comprise negatively charged layers of aluminosilicates and positively charged cations, for example $Ca^{++}$, which are positioned between the aluminosilicate layers and hold them together; or ii) oil- or grease borne soils which are typically caused by spills of frying oil, grease, tomato or spaghetti sauce, human body sweat (sebum), and non-saponifiable oil stains such as used motor oil or petroleum oils. Oil-borne stains can usually be removed by dry cleaning but this is expensive. Previously, such oily soil would have been removed using very hot (typically 60–90° C.) wash conditions, however, the current trend is to save energy and use much lower washing temperatures in the region of 15–50° C.; unfortunately, however, oily soil is not easily removed at this temperature.

Very many soil release agents are known in the art for use in domestic and industrial fabric treatment processes such as laundering, stain guarding, fabric softening etc. For example, polyesters of terephthalic and other aromatic dicarboxylic acids having soil release properties are widely disclosed in the art, such as the so-called PET/POET polymers (polyethylene terephthalate/polyoxyethylene terephthalate), which have been known for over 20 years and the PET/PEG (polyethylene terephthalate/polyethylene glycol) polymers which are taught in, for example, Canadian Patent No. 1,100,262, U.S. Pat. No. 3,557,039 and United Kingdom Patent No. GB 1,467,098.

These PET/POET and PET/PEG polymers are known to be helpful to promote the release of oily soil particularly from synthetic fibres such as polyester. It is believed that their effectiveness is due to the affinity resulting from the similarity between the structure of the PET/POET and PET/PEG polymers and the polyester fibres. Over the last few years, the backbone and side-chains in the PET/POET and PET/PEG polymers have been modified to achieve a range of cost effective polyester soil release additives which can be formulated into liquid and solid (granular) detergents. The main drawback with these materials, however, is that they offer little or no benefit on cotton and cotton blend fabrics; a much larger quantity of polymer is required before any soil release effects are observed and the PET/POET materials, in particular, have low water solubility which makes them difficult to use.

Attempts have been made to use the same approach, that is, to find soil release agents which mimic the structure of cotton and cotton-blend fabrics which will give enhanced soil release on cotton/cotton-blend fabrics. For example, United Kingdom Patent GB 1,314,897 discloses hydroxypropylmethyl cellulose laundry aids for cotton fibre; U.S. Pat. No. 5,049,302 describes a detergent composition having soil release properties comprising an anionic surfactant, a hydrotrope, a graft copolymer of polyalkylene oxide and an ester monomer and a nonionic cellulosic agent for use on cotton and cotton-blend fabrics. Others have suggested permanently modifying the chemical structure of cotton fibres by reacting the substrate with a polysaccharide polymer backbone, for example, U.S. Pat. No. 3,897,026 discloses materials having improved soil release and stain resistance properties obtained by reacting the hydroxyl moieties of the cotton fibres with an ethylene/maleic anhydride co-polymer.

However, despite the extensive research activity in this field, there remains a need for a soil release additive which has superior soil release properties, especially oil- and grease borne soil, and which is highly effective on natural fabrics such as cotton, and cotton-blend fabrics at low temperatures under domestic laundry conditions. Accordingly, the present invention provides polymer of Formula 1:

Formula 1

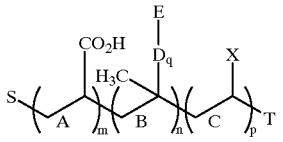

wherein:

A is a polymerized residue of a monomer selected from one or more $C_3$–$C_8$ monoethylenically unsaturated carboxylic acids;

B is a polymerized residue of a monomer selected from one or more $C_3$–$C_{60}$ alkyl(meth)acrylates, ethoxylated $C_1$–$C_{24}$ alkyl(meth)acrylates, and poly(alkylene glycol)(meth)acrylates, alkyl or aromatic ethers of poly (alkylene glycol) and the corresponding maleate mono and di-esters thereof;

C is a polymerized residue of a monomer selected from one or more ethylenically unsaturated monomers which are copolymerisable with the monomers in A and B;

A, B and C residues are randomly arranged in said polymer;

S and T are end groups;

m is the total number of A residues and is from 0 to 500;

n is the total number of B residues and is >0;

p is the total number of C residues and is from 0 to 500;

the sum of m and p is at least 1;

q is from 0 to 100; and

D is a polymerized residue of a monomer selected from poly(alkylene)oxide or alkylene oxide monomers E is selected from $C_1$–$C_{50}$ alkyl groups and $C_6$–$C_{50}$ aromatic groups.

X is a functional group.

The term "A, B and C residues are randomly arranged in said polymer" means that the residue adjacent the end group S may be either an A, B or C residue, that the residue adjacent the residue adjacent the end group S may be either an A, B or C residue, and so on.

Preferably, the polymer of Formula 1 is formed by copolymerizing two or more monomers A, B and C wherein:

i) monomer A is selected from one or more monoethylenically unsaturated $C_3$–$C_8$ monoethylenically unsaturated carboxylic acid moieties;

ii) monomer B is selected from one or more $C_3$–$C_{60}$ alkyl(meth)acrylates, ethoxylated $C_1$–$C_{24}$ alkyl(meth) acrylates, poly(alkylene glycol)(meth)acrylates, alkyl or aromatic ethers of poly(alkylene glycol) and the corresponding maleate mono and di-esters thereof;

iii) monomer C is selected from one or more ethylenically unsaturated monomers which are copolymerisable with monomers A and B;

S and T are end groups;

m is between 0 and 500;

n is >0;

p is between 0 and 500;

q is from 0–100;

D is selected from poly(alkylene)oxide or alkylene oxide monomer units; and

E is selected from $C_1$ to $C_{50}$ alkyl and $C_6$ to $C_{50}$ aromatic groups X is a functional group.

The present invention also provides a method of promoting the release of oily soil from fabric, comprising contacting the fabric with at least one polymer comprising:

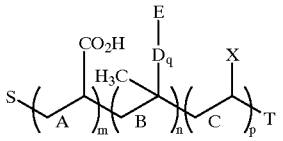

formed by copolymerising two or more monomers A, B and C wherein:

i) monomer A is selected from one or more monoethylenically unsaturated $C_3$–$C_8$ monoethylenically unsaturated carboxylic acid moieties;

ii) monomer B is selected from one or more $C_3$–$C_{60}$ alkyl(meth)acrylates, ethoxylated $C_1$–$C_{24}$ alkyl(meth) acrylates, and poly(alkylene glycol)(meth)acrylates, alkyl or aromatic ethers of poly(alkylene glycol) and the corresponding maleate mono and di-esters thereof;

monomer C is selected from one or more ethylenically unsaturated monomers which are copolymerisable with monomers A and B;

S and T are end groups;

m is between 0 and 500;

n is >0;

p is between 0 and 500;

q is from 0–100; and

D is selected from poly(alkylene)oxide or alkylene oxide monomer units.

E is selected from $C_1$–$C_{50}$ alkyl and aromatic groups.

X is a functional group.

Preferably, the molecular weight of the backbone, as measured on the polymer product after exhaustive hydrolysis, comprising polymerizedunits of A, B and C, is at least 500 and may be up to 500,000. Backbone molecular weights of from 500 to 150,000 are especially preferred.

The value m is preferably between 0 and 500. The ratio of m+p:n may be 100:1, preferably 50:1 and particularly preferred is a ratio of between 10:1 to 1:1.

Monomer A, may be selected from $C_3$–$C_8$ monoethylenically unsaturated carboxylic acid moieties. Suitable carboxylic acids include monoethylenically unsaturated monocarboxylic acids and monoethylenically unsaturated dicarboxylic acids. For example, monoethylenically unsaturated carboxylic acids include acrylic acid (AA), methacrylic acid (MAA), alpha-ethacrylic acid, β,β-dimethylacrylic acid, methylenemalonic acid, vinylacetic acid, allylacetic acid, ethylidineacetic acid, propylidineacetic acid, crotonic acid, maleic acid (MAL), maleic anhydride (MALAN), fumaric acid, itaconic acid, citraconic acid, mesaconic acid, and alkali and metal salts thereof Preferably, the monoethylenically unsaturated carboxylic acid is one or more of acrylic, methacrylic or maleic acid. $C_3$–$C_6$ monoethylenically unsaturated carboxylic acids are especially preferred.

Monomer B is preferably selected from one or more of $C_{12}$–$C_{20}$ alkyl(meth)acrylates, ethoxylated $C_{12}$–$C_{20}$ alkyl (meth)acrylates, poly($C_2$–$C_3$ alkyleneglycol)(meth) acrylates, alkyl or aromatic ethers of poly($C_2$–$C_3$ alkylene glycol)(meth)acrylates and the corresponding maleate mono and di-esters thereof. Suitable (meth)acrylates include propyl and higher linear and branched alkyl esters of (meth) acrylic acid including isopropyl acrylate, stearyl methacrylate 2-ethyl hexyl acrylate; aromatic and alkyl aromatic esters of (meth)acrylic acid, (meth)acrylic acid esters of polyethylene glycol, polypropylene glycol, mixed polyethylene glycol/polypropylene glycol esters, and methyl and higher alkyl and aromatic ethers of these glycol (meth) acrylates, including polyethylene glycol (meth)acrylate and di-(meth)acrylate, polypropylene glycol(meth)acrylate and di-(meth)acrylate, polyethylene glycol co-poly propylene glycol(meth)acrylate and di-(meth)acrylate and methyl ethers thereof, and the (meth)acrylate esters of —OH terminated nonionic surfactants, and the corresponding maleate esters thereof. The poly(alkylene)glycols preferably have a molecular weight of from 200 to 5000, preferably from 200 to 1000.

Monomer C can be either an anionic, nonionic or cationic monoethylenically unsaturated monomer selected from one or more monoethylenically unsaturated monomers which are polymerizable with monomers A and B and are at least partially soluble in water or the reaction solvent, or in the other monomers if no water or solvent is used. Suitable monomers include one or more of the $C_3$–$C_8$ monoethylenically unsaturated carboxylic acids and their alkali metal and ammonium salts as used for monomer A; $C_1$–$C_4$ alkyl esters of acrylic acid and methacrylic acid such as methyl acrylate (MA), ethyl acrylate (EA), butyl acrylate (BA), methyl methacrylate (MMA) and butyl methacrylate (BMA); $C_1$–$C_4$ hydroxyalkyl esters of acrylic acid and methacrylic acid such as hydroxyethlyacrylate (HEA), hydroxypropyl acrylate (HPA), and hydroxyethyl methacrylate (HEMA); acrylamide (Am), alkyl substituted acrylamides, such as methacrylamide (MAM), tert-butyl acrylamide (t-BAM) and N-tert-octyl acrylamide (t-OAM); styrene (Sty), sulfonated styrene (SS), sulfonated alkyl acrylamides, such as 2-acrylamidomethylpropanesulfonic (AMPS), vinyl sulfonates, allylsulfonic acid, methallylsulfonic acid, vinyl phosphonic acid, vinyl acetate, allyl alcohols, acrylonitrile, N-vinylpyrrolidone, acryloyl morpholine, N-vinylformamide, N-vinylimidazole, N-vinylpyridine; N,N-dimethylaminoethyl methacrylate (DMAEMA), N,N-dimethylaminoethyl acrylate (DMAEA), dialkyldimethyl ammonium chloride; [2-(methacryloloxy) ethyl]ammonium chloride, diallyldimethyl ammonium chloride (DADMAC), N-[3-(dimethylamino)propyl)acrylamide (DMAPA), N-[3-(dimethylamino)propyl)methacrylamide (DMAPMA) and (3-acrylamidopropyl)-trimethylammonium chloride (APTAC) and 2-(3-oxazolidinyl) ethyl methacrylate (OXEMA).

S and T are preferably derived from one or more initiator radicals, chain transfer agents or other groups which may be grafted onto the backbone via a radical reaction. S and T may be selected from one or more of H; OH; $CH_2R$ where R=H or $C_1$ to $C_{30}$ alkyl, cycloalkyl or alkylaromatic hydrocarbons; alcohols; ethers such as $(CH_2CH_2O)_rR$ where R is as defined above, and r is from 1 to 60; mixed poly(alkylene oxide) block copolymers such as $(CH_2CH_2.O)_s(CH_2CH_3CH_2O)_tR$ where R is as defined above, and s+t is from 2 to 60 or $(CH_2CH_3CH_2O)_u(CH_2CH_2O)_vR$ where R is as defined above, and u+v is from 2 to 60; sulphur or a sulphur containing groups such as, SR, $SO_2R$, $SO_3H$, $SO_4H$ and salts thereof in which R is as defined above; and $N(H)R^1$ where $R^1$=H or $C_1$ to $C_{15}$ alkyl.

D is selected from poly(($C_2$–$C_4$)alkylene)oxides or ($C_2$–$C_4$)alkylene)oxides monomers.

E is selected from $C_1$–$C_{50}$ alkyl, alkaryl and aralkyl groups. Preferably, E comprises—linear or branched ($C_1$–$C_{24}$)alkyl, ($C_1$–$C_{24}$)alkaryl and ($C_1$–$C_{24}$)aralkyl groups, including but not limited to methyl, ethyl, butyl, n-octyl, dodecyl and stearyl, octylphenyl, nonylphenyl or dodecylphenyl, and benzyl or tolyl radicals. X is selected from groups such as acids, esters, amides, amines, nitrites, styrene and vinyl ethers.

The polymers of the present invention may be made by any suitable method, for example, by the methods described in U.S. Pat. Nos. 4,797,223, 4,404,309, 5,008,329 and 4,956,421, which methods are incorporated herein by reference.

It is contemplated that the polymer composition used in the method of the present invention will be made to contact the fabric in at least one of the following ways: i) by, for example, dabbing, dipping or spraying the fabric with a solution containing the polymer prior to soiling, this may be carried out as a fabric pre-use treatment operation to protect the surface of the fabric to prevent it from staining during use; ii) contacting the fabric with a solution of the polymer by, for example, dabbing, spraying or dipping prior to washing in a "pre-spotting" fabric treatment operation; iii) combining the polymer composition with the fabric detergent so that the polymer contacts the fabric using a "through-the-wash" treatment process and iv) combining the polymer composition with a rinse added fabric softener through the rinse cycle of the washing operation.

The polymer composition used in the present invention may be used in solid form, such as a spray dried powder or granules, or in liquid form, preferably it will be used as an aqueous or co-solvent based solution.

The polymer composition may also contain crosslinkers to build polymer molecular weight and to produce modified polymer structures/conformations. These may include materials such as methylene bisacrylamide, pentaerythritol, di-, tri- and tetraacrylates, divinylbenzene, polyethylene glycol diacrylates and bisphenol A diacrylates.

The polymers of the present invention can be used in their present (acidic) form or neutralized to form salts containing carboxylate anions. Preferred alkali metal ions typically include sodium or potassium, alkaline earth metal cations such as magnesium and calcium, ammonium or tetra-alkyl ammonium salts, such as tetramethylammonium, or organic amine salts, such as the salts of tri-$C_1$–$C_4$ alkylamines, hydroxyethylamines, or the mono-, di- or tri-$C_1$–$C_4$-alkanolamines, or mixtures thereof.

As well as promoting the release of oily soil from fabrics, particularly cotton and cotton-containing fabrics, the present invention also provides the advantage in that it reduces fabric dinginess, that is, the dullness observed in respect of fabric which has endured repeated wash cycles. In a preferred embodiment of the present invention, the polymer composition is also effective at promoting the release of clay soil from fabrics, especially cotton and cotton-containing fabrics.

The invention will now be described with reference to the following examples. By way of example, certain hydrophobically modified polymers of the present invention may be prepared according to Examples 1–6 below:

EXAMPLE 1

To a one liter round bottom four neck flask, equipped with a stirrer, condenser, thermocouple and inlets for the addition of monomer and initiator was charged 130 grams of isopropanol. A monomer mix of 89.05 grams glacial acrylic acid and 16.85 grams of a 65% surfactant monomer solution ($C_{12}$Methacrylate 4EO) was prepared. An initiator mix of 1.43 grams of a 70% t-Butyl Peroxypivalate and 10 grams of isopropanol was prepared. The contents of the flask was heated to 78° C. and the monomer and initiator mixes were added linearly over a period of two hours. At the completion of the feeds, the reaction was held for one hour at 78° C., then cooled and packaged. The final solids were 43.7%. A portion of the sample was hydrolyzed with potassium hydroxide at elevated temperature. The final backbone molecular weight as determined by Gel Permeation Chromatography was Mw=9080 and Mn=5800.

EXAMPLE 2

To a one liter round bottom four neck flask, equipped with a stirrer, condenser, thermocouple and inlets for the addition of monomer and initiator and nitrogen sparge was charged 100 grams of methanol. A monomer mix of 61.92 grams glacial acrylic acid and 58.58 grams of a 65% surfactant monomer solution ($C_{12}$Methacrylate 4EO) was prepared. An initiator mix of 1 gram of 2,2'-Azobis(N,N'-dimethyleneisobutyramidine)dihydrochloride and 96 grams of methanol was prepared. The contents of the flask was heated to 64° C. and the monomer and initiator mixes were added linearly over a period of two hours. At the completion of the feeds, the reaction was held for one hour at 64° C., then cooled and packaged. The final solids were 36.2%. A portion of the sample was hydrolyzed with potassium hydroxide at elevated temperature. The final backbone molecular weight as determined by Gel Permeation Chromotography was Mw=34300 and Mn=15900.

EXAMPLE 3

(Experimental Polymer 6)

To a one liter round bottom four neck flask, equipped with a stirrer, condenser, thermocouple and inlets for the addition of monomer and initiator and nitrogen sparge was charged 65 grams of methanol. A monomer mix of 89.05 grams glacial acrylic acid and 16.85 grams of a 65% surfactant monomer solution ($C_{12}$Methacrylate 4EO) was prepared. An initiator mix of 1 gram of 2,2'-Azobis(N,N'-dimethyleneisobutyramidine)dihydrochloride and 96 grams of methanol was prepared. The contents of the flask was heated to 64° C. and the monomer and initiator mixes were added linearly over a period of two hours. At the completion of the feeds, the reaction was held for one hour at 64° C., then cooled and packaged. The final solids were 39.7%. A portion of the sample was hydrolyzed with potassium hydroxide at elevated temperature. The final backbone molecular weight as determined by Gel Permeation Chromotography was Mw=39500 and Mn=14000.

EXAMPLE 4

(Experimental Polymer 8)

To a one liter round bottom four neck flask, equipped with a stirrer, condenser, thermocouple and inlets for the addition of monomers and initiator and nitrogen sparge was charged 100 grams of methanol. A monomer mix of 89.05 grams glacial acrylic acid and 16.85 grams of a 65% surfactant monomer solution ($C_{12}$Methacrylate 4EO) was prepared. A second monomer mix of 6.86 grams of a 60% solution of Diallyl-dimethyl ammonium chloride and 42 grams of methanol was prepared. An initiator mix of 1 gram of 2,2'-Azobis(N,N'-dimethyleneisobutyramidine) dihydrochloride and 96 grams of methanol was prepared. The contents of the flask was heated to 64° C. and the monomers and initiator mixes were added linearly over a period of two hours. At the completion of the feeds, the reaction was held for one hour at 64° C., then cooled and packaged. The final solids were 30.1%. A portion of the sample was hydrolyzed with potassium hydroxide at elevated temperature. The final backbone molecular weight as determined by Gel Permeation Chromotography was Mw=33500 and Mn=14600.

EXAMPLE 5

(Experimental Polymer 11)

To a one liter round bottom four neck flask, equipped with a stirrer, condenser, thermocouple and inlets for the addition of monomer and initiator and nitrogen sparge was charged 125 grams of methanol. A monomer mix of 89.05 grams glacial acrylic acid, 6.46 grams of lauryl methacrylate and 10 grams of methanol. An initiator mix of 1 gram of 2,2'-Azobis(N,N'-dimethyleneisobutyramidine) dihydrochloride and 96 grams of methanol was prepared. The contents of the flask was heated to 64° C. and the monomers and initiator mixes were added linearly over a period of two hours. At the completion of the feeds, the reaction was held for one hour at 640° C., then cooled and packaged. The final solids were 29.4%. A portion of the sample was hydrolyzed with potassium hydroxide at elevated temperature. The final backbone molecular weight as determined by Gel Permeation Chromotography was Mw=29200 and Mn=13100.

EXAMPLE 6

(Experimental Polymer 16)

To a one liter round bottom four neck flask, equipped with a stirrer, condenser, thermocouple and inlets for the addition of monomer and initiator and nitrogen sparge was charged 100 grams of methanol. A monomer mix of 89.05 grams glacial acrylic acid, 12.7 grams of Polyethylene glycol—400 Monomethyl ether monomethacrylate and 10 grams of methanol. An initiator mix of 1 gram of 2,2'-Azobis(N,N'-dimethyleneisobutyramidine)dihydrochloride and 96 grams of methanol was prepared. The contents of the flask was heated to 64° C. and the monomers and initiator mixes were added linearly over a period of two hours. At the completion of the feeds, the reaction was held for one hour at 64° C., then cooled and packaged. The final solids were 28.4%. A portion of the sample was hydrolyzed with potassium hydroxide at elevated temperature. The final backbone molecular weight as determined by Gel Permeation Chromotography was Mw=25400 and Mn=12500.

Performance Evaluations

The efficacy of the polymers of this invention in liquid and powder detergent formulations was evaluated by washing soiled cotton duck fabrics (virgin cotton) in commercially available powder and liquid laundry formulations and a prototypical liquid detergent utilizing a United States Testing Company Terg-O-Tometer (Model 7243-S) washing apparatus set to typical U.S. laundering parameters. Washing conditions are detailed in Table 1 below, and the prototypical liquid detergent base used for evaluating the polymer compositions of the invention is illustrated in Table 2. Table 3 shows other suitable formulations for powder and liquid detergents which are possible but not limiting for use with the polymers of this invention.

Test Protocol a) Pre-treatment of Fabric By Direct Application Of Polymers Prior to Soiling and Washing The polymer compositions were applied onto Cotton Duck fabric, purchased from TestFabrics, Inc. (West Pittston, Pa.), by spraying 1.0 gram of a 1% neutralized polymer solution directly onto the cloth. The fabrics were then allowed to air dry overnight.

The Cotton Duck was then cut into test pieces of a specified size (3½"×4½"), and these were then soiled by applying 0.6 grams of a dust sebum emulsion or a 25% clay slurry (in water) using a China bristle brush (#10). The dust sebum emulsion was purchased from Scientific Services (Sparrow Bush, N.Y.) and was made according to the Spangler procedure (JAOCS, 42, 723 (1965)). The local clay used to soil cloths was deep orange in color and milled repeatedly until passing through a 200 mesh screen. The soils were "painted" onto the cloth inside a 2" diameter circle and allowed to air dry overnight prior to laundering using the typical wash conditions as detailed in Table 1.

The reflectance of each cloth was measured using a Hunter Lab Colorimeter (ColorQUEST™ 45/0) and the data recorded using the X, Y and Z colour scale. The Reflectance (Y) was usually measured before laundering so that only cloths of the same reflectance were used in a given test. Reflectance was then measured after laundering to evaluate the efficacy of the detergent. The ΔY values reported in Table 4 are the change in reflectance relative to the control cloths laundered in detergent but without pretreatment with polymer.

Each of the soils were evaluated using a minimum of two replicates. The data appearing in Table 4 are composite averages of the reflectance values obtained from the individual soils.

TABLE 1

| Wash Conditions | |
|---|---|
| Washing Apparatus: | United States Testing Company Terg-O-Tometer (Model 7243-S) |
| Wash Temperature | 30° C. |
| Water Hardness | 120 ppm (2/1 $Ca^{++}/Mg^{++}$) |
| Agitation | 100 rpm |
| Wash Cycle | 12 minutes |
| Rinse Cycle | 3 minutes |
| Water Capacity | 1 Liter |
| Detergent Concentration | 0.15% |
| Polymer Concentration | 0.01% |

TABLE 2

Prototypical Liquid Detergent

| Components | % by Weight |
|---|---|
| Linear Alkyl Benzene Sulfonate | 16.0 |
| Witcolate SE-5[2] | 4.0 |
| Neodol 23-6.5[a] | 10.0 |
| Sodium Citrate · $2H_2O$ | 5.0 |
| Propylene Glycol | 5.0 |
| Sodium Xylene Sulfonate | 2.5 |
| Monoethanolamine | 2.0 |
| Deionized Water/Misc.[1] | Balance |

[1]Miscellaneous includes optical brighteners, enzymes, chlorine scavengers, colorants, fragrance and opacifiers.
[2]$C_{10}$–$C_{16}$ Alkyl Ether Sulfate, Sodium Salt (from Witco Corp.)

TABLE 2-continued

Prototypical Liquid Detergent

| Components | % by Weight |
|---|---|
| [3]$C_{12}$–$C_{13}$ Alcohol Ethoxylate with an average of 6.5 moles EO (from Shell Oil Co.) | |

TABLE 3

Typical Powder, Bar and Liquid Detergent Formulations

| Component | Phosphate | Non-Phosphate | Bar | Built Liquid |
|---|---|---|---|---|
| Sodium Alkyl Benzene Sulfonate | 6 | 7.5 | 7.5 | 7 |
| Sodium Alcohol Ether Sulfate | | 5 | | 3 |
| Nonionic Alcohol Ethoxylate | | 2.5 | | 2 |
| Sodium Tripolyphosphate | 30 | | 15 | 20 |
| Sodium Carbonate | 10 | 10 | 7.5 | 8 |
| Zeolite A | | 25 | | |
| Sodium Perborate | 20 | 20 | | |
| TAED[2] | 5 | 5 | | |
| Acusol 479N[3] | | 4 | | |
| Fatty Acid Soap | | | 30 | |
| Sodium Sulfate | 15 | 6 | | |
| Sodium Silicate | 5 | 2.5 | | |
| Borax | | | | 2.5 |
| Glycerin | | | | 5 |
| Talc | | | 30 | |
| Water/Misc.[1] | Balance | Balance | Balance | Balance |

[1]Miscellaneous includes optical brighteners, enzymes, chlorine scavengers, colorants, fragrance and opacifiers.
[2]TetraAcetyl Ethylene Diamine
[3]Acrylic/Maleic Copolymer, Sodium Salt, 70,000 $M_w$ (from Rohm and Haas)

TABLE 4

| Polymer/Additive | Composition | Mw | Reflectance (ΔY) Dust Sebum | Reflectance (ΔY) Big Oak Clay |
|---|---|---|---|---|
| Comparative 1 | (Tergitol 15-S-3[1]) C11/15 w/3 moles EO | 332 | −3.5 | 2.5 |
| Comparative 2 | (Tergitol 15-S-7[2]) C11/15 w/7 moles EO | 508 | 0.8 | 1.4 |
| Comparative 3 | 100 AA (IPA) | 3.72K | 2.2 | 0.9 |
| Experimental 1 | AA/E4LMA (89.1/10.9) | 3.25K | 4.5 | 1.2 |
| Experimental 2 | AA/E4LMA (61.9/38.1) | <5K | 3.9 | 0.8 |
| Experimental 3 | AA/E12LMA (81.7/18.3) | <5K | 3.5 | 1.6 |
| Experimental 4 | AA/E12LMA (47.2/52.8) | <5K | 5.8 | 0.5 |
| Experimental 5 | AA/E4LMA (89.1/10.9) | 85.3K | 16.5 | −17.2 |
| Experimental 6 | AA/E4LMA (89.1/10.9) | 39.5K | 13.6 | −9.7 |
| Experimental 7 | AA/E12LMA (47.2/52.8) | 24.2K | 5.7 | −9.9 |
| Experimental 8 | AA/E4LMA (89.1/10.9); 3.9% DADMAC | 33.5K | 4.7 | −12.0 |
| Experimental 9 | AA/E4LMA (89.1/10.9); 5.0% MAETMAC | 33.0K | 10.0 | −12.4 |
| Experimental 10 | AA/HEA/E4LMA (89.1/10.9); 80/20 mole % AA/HEA | 35.0K | 9.6 | −10.8 |
| Experimental 11 | AA/LMA (93.2/6.8) | 29.2K | 10.5 | −7.0 |
| Experimental 12 | AA/E4LMA (89.1/10.9); 0.8% methylene bisacrylamide | 30.8K | 13.9 | −13.7 |
| Experimental 13 | AA/E4LMA (89.1/10.9); 2.2% PEG 400 diacrylate | 27.3K | 10.5 | −7.6 |
| Experimental 14 | AA/E4LMA (14.4/85.6) | 13.5K | 4.2 | 2.0 |
| Experimental 15 | AA/E12LMA (8.4/91.6) | 13.3K | 6.5 | 0.9 |
| Experimental 16 | AA/PEG 400 (87.5/12.5) | 25.4K | 11.2 | −3.8 |
| Experimental 17 | HEA/PEG 400 (49.8/50.2) | 11.5K | −4.0 | −5.5 |
| Experimental 18 | MMA/PEG 400 (46.9/53.1) | 11.6K | 1.4 | 5.0 |
| Experimental 19 | AA/Mal/E4LMA (64.2/25.8/10.0) | 20.1K | 12.6 | −7.4 |
| Experimental 20 | AA/E4NPE (88.7/11.3) | 22.0K | 11.1 | −9.0 |

TABLE 4-continued

| Polymer/Additive | Composition | Mw | Reflectance (ΔY) Dust Sebum | Big Oak Clay |
|---|---|---|---|---|
| Experimental 21 | Am/E4LMA (89.1/10.9) | 28.8K | 7.1 | −11.1 |
| Experimental 22 | AA/E20CSMA (74.3/25.7) | 30.1K | 13.0 | 2.7 |
| Experimental 23 | AA/E23LMMA (73.2/26.8) | 37.1K | 14.8 | −2.4 |
| Experimental 24 | AA/E20CSMA (7.8/92.2) | 8.6K | 5.6 | 4.2 |
| Experimental 25 | AA/E23LMMA (5.4/94.6) | 11.1K | 10.4 | 3.0 |

KEY: All values listed as Percent by Weight
[1]Tergitol 15-S-3, Secondary Alcohol Ethoxylate, $C_{11}/C_{15}$ with an Average of 3 moles of EO (from Union Carbide)
[2]Tergitol 15-S-7, Secondary Alcohol Ethoxylate, $C_{11}/C_{15}$ with an Average of 7 moles of EO (from Union Carbide)
AA = acrylic acid
HEA = hydroxy ethyl acrylate
Mal = maleic acid
MMA = methyl methacrylate
Am = acrylamide
DADMAC = dialkyldimethyl ammonium chloride
MAETMAC = [2-(Methacryloloxy)ethyl]trimethyl ammonium chloride
E4LMA = $C_{12}$Methacrylate 4EO
E12LMA = $C_{12}$Methacrylate12EO
LMA = lauryl methacrylate ($C_{12}$ Methacrylate)
PEG 400 = poly(ethylene glycol) (Av. Wt. 400)
E4NPE = nonylphenol ethoxylate-4EO
E20CSMA = $C_{16/18}$Methacrylate 20EO
E23LMMA = $C_{12/14}$Methacrylate 23EO From the results described in Table 4, one can observe that the experimental polymer compositions deliver enhanced dust sebum soil release on cotton fabric under typical laundering conditions. Application of oil-soluble and water-soluble nonionic alcohol ethoxylates (Comparatives 1 and 2, respectively) and a conventional polycarboxylic acid homopolymer (Comparative 3) to the same cotton fabric provides minimal efficacy benefits through the wash.

Polymers of the present invention which contain higher mole ratios of pendant surfactant monomers to backbone monomers (see for example, experimental polymers 14, 15, 22 and 24), were particularly advantageous since they deliver enhanced dust sebum and clay soil release on clay based soils on cotton fibres.

b) Pre-treatment of Fabrics By Using the Polymer in Conjunction with a Rinse Added Fabric Softener Prior Soiling and Laundering The polymers of this invention were also evaluated for soil release benefits in combination with Rinse Added Fabric Softeners. Cotton duck cloths were washed in a prototypical liquid detergent (Table 2) utilizing a United States Testing Company Terg-O-Tometer under typical U.S. washing conditions (as previously described). During the abbreviated rinse cycle, 50 ppm of ditallow dimethyl ammonium chloride (Adogen 442-100P) or ditallow esterquat (Stepantex VL 90) was added to the rinse water. Various polymer compositions were added at concentrations typically ranging from 5–25 ppm in concert with the quaternary surfactant. This process was repeated for three complete wash/rinse cycles (as described in Table 5). The fabrics were then allowed to air dry overnight, soiled and then laundered the following day.

The reflectance of each cloth was measured using a Hunter Lab Colorimeter (ColorQUEST™ 45/0) and the data recorded using the X, Y and Z color scale. The Reflectance (Y) was usually measured before laundering so that only cloths of the same reflectance were used in a given test. Reflectance was then measured after laundering to evaluate the effectiveness of the polymer in the rinse cycle additive (ditallow dimethyl ammonium chloride, unless otherwise noted). The ΔY values reported in Table 6 are the change in reflectance relative to the control cloths laundered in the RAFS without polymer.

Each of the soils were evaluated using a minimum of two replicates. The data appearing in Table 6 are composite averages of the reflectance values obtained from the individual soils.

From the results depicted in Table 6, one can observe that the addition of the inventive polymer compositions to a rinse added fabric softener formulation provides for enhanced soil release of a synthetic body sweat/collar soil from cotton garments. These improvements in cleaning efficacy are observed at concentrations as low as 5 ppm polymer in the rinse bath.

TABLE 5

| Rinse Conditions | |
|---|---|
| Apparatus: | United States Testing Company Terg-O-Tometer (Model 7243-S) |
| Temperature | 22° C. |
| Water Hardness | 120 ppm (2/1 $Ca^{++}/Mg^{++}$) |
| Agitation | 100 rpm |
| Wash Cycle | 12 minutes |
| Rinse Cycle | 3 minutes |
| Water Capacity | 1 Liter |
| Rinse Additive Concentration[1] | 0.05% |
| Polymer Concentration | 0.015% |

The rinse additives used for the washing assessments were Adogen 442-100P (DiTallowDiMethyl Ammonium Chloride, DTDMAC, from Witco Corp.) and Stepantex VL 90 (Quaternary Methoxysulfate, DiTallow EsterQuat, from Stepan Company)

TABLE 6

| Polymer/Additive | Composition | Mw | Polymer Concentration (ppm) | Reflectance (ΔY) (Dust Sebum) |
|---|---|---|---|---|
| Experimental 6 | AA/E4LMA (89.1/10.9) | 39.5K | 25 | 3.4 |
| Experimental 8 | AA/E4LMA (89.1/10.9); 3.9% DADMAC | 33.5K | 25 | 3.2 |
| Experimental 22 | AA/E20CSMA (74.3/25.7) | 30.1K | 15 | 3.5 |
| Experimental 23 | AA/E23LMMA (73.2/26.8) | 37.1K | 15 | 4.4 |
| | | | 25 | 3.4 |
| | | | 10 | 5.7* |
| | | | 15 | 5.0* |
| Experimental 24 | AA/E20CSMA (7.8/92.2) | 8.6K | 5 | 1.6 |
| Experimental 25 | AA/E23LMMA (5.4/94.6) | 11.1K | 5 | 4.5 |
| | | | 10 | 4.1* |

*In these assessments the Rinse Added Fabric Softener is the ditallow esterquat (Stepantex VL 90)
KEY: All values listed as Percent by Weight
AA = acrylic acid
DADMAC = dialkyl dimethyl ammonium chloride
E4LMA = $C_{12}$Methacrylate 4EO
E20CSMA = $C_{16/18}$Methacrylate 20EO
E23LMMA = $C_{12/14}$Methacrylate 23EO

What is claimed is:

1. A method of promoting the release of oily soil from fabric, comprising contacting the fabric with at least one polymer of Formula 1:

Formula 1

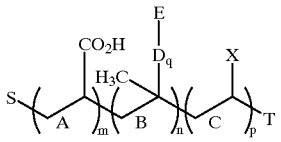

wherein:

A is a polymerized residue of a monomer selected from one or more $C_3$–$C_8$ monoethylenically unsaturated carboxylic acids;

B is a polymerized residue of a monomer selected from one or more ethoxylated $C_1$–$C_{24}$ alkyl (meth)acrylates, poly(alkylene glycol) (meth)acrylates, alkyl and the corresponding maleate mono and di-esters thereof;

C is a polymerized residue of a monomer selected from one or more ethylenically unsaturated monomer which are copolymerisable with the monomers in A and B;

A, B and C residues are randomly arranged in said polymer;

S and T are end groups;

m is the total number of A residues and is from 0 to 500;

n is the total number of B residues and is >0;

p is the total number of C residues and is from 0 to 500;

the sum of m and p is at least 1;

q is from 0 to 100;

D is a $C_2$–$C_4$ alkylene oxide group;

E is selected from $C_1$–$C_{50}$ alkyl groups and $C_6$–$C_{50}$ aromatic groups;

X is a functional group;

and wherein the polymer is applied to the fabric prior to soiling.

2. Method according to claim 1 where in a solution of the polymer(s) contacts the fabric directly by dabbing, dipping or spraying in a fabric pre-use treatment.

3. Method according to claim 1 wherein the polymer(s) contacts the fabric prior to fabric washing in a pre-spotting treatment.

4. Method according to claim 1 wherein the ratio of m+p:n is from 10:1 to 1:1.

5. Method according to claim 1 wherein polymer backbone molecular weight, as measured on the polymer product after exhaustive hydrolysis, comprising said polymerized residues A, B and C, is from 500 to 500,000.

6. Method according to claim 1 wherein A is a polymerised residue of a monomer selected from one or more of acrylic acid (AA), methacrylic acid (MAA), alpha-ethacrylic acid, β,β-dimethylacrylic acid, methylenemalonic acid, vinylacetic acid, allylacetic acid, ethylidineacetic acid, propylidineacetic acid, crotonic acid, maleic acid (MAL), maleic anhydride (MALAN), fumaric acid, itaconic acid, citraconic acid, mesaconic acid, and alkali and metal salts thereof.

7. Method according to claim 1 wherein B is a polymerised residue of a monomer selected from one or more ethoxylated $C_{12}$–$C_{20}$ alkyl(meth)acrylates, poly($C_2$–$C_3$ alkylene glycol)(meth)acrylates and the corresponding maleate mono and di-esters thereof.

8. Method according to claim 1 wherein C is a polymerised residue of a monomer selected from one or more of the $C_3$–$C_8$ monoethylenically unsaturated carboxylic acids and their alkali metal and ammonium salts as used for monomer A; $C_1$ to $C_4$ alkyl esters of acrylic acid and methacrylic acid selected from methyl acrylate (MA), ethyl acrylate (EA), butyl acrylate (BA), methyl methacrylate (MMA) and butyl methacrylate (BMA); $C_1$ to $C_4$ hydroxyalkyl esters of acrylic acid and methacrylic acid such as hydroxyethlyacrylate (HEA), hydroxypropyl acrylate (HPA), and hydroxyethyl methacrylate (HEMA); acrylamide (Am), alkyl substituted acrylamides, selected from methacrylamide (MAM), tert-butyl acrylamide (t-BAM) and N-tert-octyl acrylamide (t-OAM); styrene (Sty), sulfonated styrene (SS), sulfonated alkyl acrylamides, selected from 2-acrylamidomethylpropanesulfonic (AMPS), vinyl sulfonates, allylsulfonic acid, methallylsulfonic acid, vinyl phosphonic acid, vinyl acetate, allyl alcohols, acrylonitrile, N-vinylpyrrolidone, acryloyl morpholine, N-vinylformamide, N-vinylimidazole, N-vinylpyridine; N,N-dimethylaminoethyl methacrylate (DMAEMA), N,N-dimethylaminoethyl acrylate (DMAEA), dialkyldimethyl ammonium chloride; [2-(methacryloloxy)ethyl]ammonium chloride, diallyldimethyl ammonium chloride (DADMAC), N-[3-(dimethylamino)propyl)acrylamide (DMAPA), N-[3-(dimethylamino)propyl)methacrylamide (DMAPMA), (3-acrylamidopropyl)-trimethylammonium chloride (APTAC) and 2-(3-oxazolidinyl)ethyl methacrylate (OXEMA).

9. A method of promoting the release of oily soil from fabric, comprising contacting the fabric with a rinse added fabric softener composition including at least one polymer of Formula 1:

Formula 1

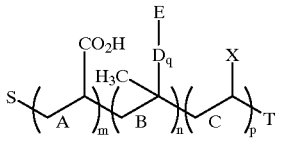

wherein:

A is a polymerized residue of a monomer selected from one or more $C_3$–$C_8$ monoethylenically unsaturated carboxylic acids;

B is a polymerized residue of a monomer selected from one or more ethoxylated $C_1$–$C_{24}$ alkyl(meth)acrylates, poly(alkylene glycol)(meth)acrylates, alkyl and the corresponding maleate mono and di-esters thereof;

C is a polymerized residue of a monomer selected from one or more ethylenically unsaturated monomers which are copolymerisable with the monomers in A and B;

A, B and C residues are randomly arranged in said polymer;

S and T are end groups;

m is the total number of A residues and is from 0 to 500;

n is the total number of B residues and is >0;

p is the total number of C residues and is from 0 to 500;

the sum of m and p is at least 1;

q is from 0 to 100;

D is a $C_2$–$C_4$ alkyl oxide group;

E is selected from $C_1$–$C_{50}$ alkyl groups and $C_6$–$C_{50}$ aromatic groups;

X is a functional group; wherein the ratio of m+p:n is from 10:1 to 1:1;

and wherein the polymer(s) composition contacts the fabric during a fabric rinsing cycle.

10. A method of promoting the release of oily soil from fabric, comprising contacting the fabric with at least one polymer of Formula 1:

Formula 1

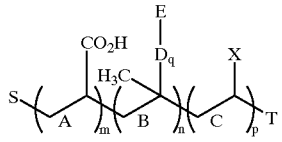

wherein:

A is a polymerized residue of a monomer selected from one or more $C_3$–$C_8$ monoethylenically unsaturated carboxylic acids;

B is a polymerized residue of a monomer selected from one or more ethoxylated $C_1$–$C_{24}$ alkyl(meth)acrylates, poly(alkylene glycol)(meth)acrylates, alkyl and the corresponding maleate mono and di-esters thereof;

C is a polymerized residue of a monomer selected from one or more ethylenically unsaturated monomers which are copolymerisable with the monomers in A and B;

A, B and C residues are randomly arranged in said polymer;

S and T are end groups;

m is the total number of A residues and is from 0 to 500;

n is the total number of B residues and is >0;

p is the total number of C residues and is from 0 to 500;

the sum of m and p is at least 1;

q is from 0 to 100;

D is a $C_2$–$C_4$ alkylene oxide group;

E is selected from $C_1$–$C_{50}$ alkyl groups and $C_6$–$C_{50}$ aromatic groups;

X is a functional group; wherein the ratio of m+p:n is from 10:1 to 1:1;

and wherein the polymer(s) composition contacts the fabric during a fabric rinsing cycle.

* * * * *